US006029952A

United States Patent [19]

Huggett et al.

[11] Patent Number: 6,029,952

[45] Date of Patent: Feb. 29, 2000

[54] MULTI-SPEED WINCH HAVING SPEED SELECTION MECHANISM

[75] Inventors: Richard David John Huggett, Horndean; David Roberts, Locksheath, both of United Kingdom

[73] Assignee: Lewmar Marine Limited, Havant, United Kingdom

[21] Appl. No.: 08/964,591

[22] Filed: Nov. 5, 1997

[30] Foreign Application Priority Data

Nov. 18, 1996 [GB] United Kingdom ..... 9623949

[51] Int. Cl.[7] ..... B66D 1/22

[52] U.S. Cl. ..... 254/344; 254/354; 475/294; 475/296

[58] Field of Search ..... 254/342, 344, 254/345, 353, 354, 369; 475/294, 296, 338

[56] References Cited

U.S. PATENT DOCUMENTS

| | | | |
|---|---|---|---|
| Re. 30,881 | 3/1982 | Huggett et al. | 254/345 |
| 3,670,589 | 6/1972 | Carter | 254/344 X |
| 3,728,914 | 4/1973 | Guangorena et al. | 254/354 X |
| 3,962,935 | 6/1976 | Hutton et al. | 254/344 X |
| 4,003,274 | 1/1977 | Hirsiefer | 475/296 |
| 4,725,043 | 2/1988 | Atfield et al. | 254/354 |
| 4,974,814 | 12/1990 | Cundy | 254/342 X |
| 5,368,279 | 11/1994 | Ottemann et al. | 254/342 |
| 5,370,366 | 12/1994 | Ottemann | 254/344 X |

OTHER PUBLICATIONS

WO 94114646, Resch et al, Oct. 1991.

*Primary Examiner*—Donald P. Walsh
*Assistant Examiner*—Emmanuel M. Marcelo
*Attorney, Agent, or Firm*—St. Onge Steward Johnston & Reens LLC

[57] ABSTRACT

A single mechanism mounted at the head of a winch has a double-selector function, allowing either 1st or 2nd ratio of drive to a drum to be selected upon initial rotation of the drive shaft. The mechanism is mounted coaxially with the drum and shaft and has coaxial inner and outer control buttons. Its body can be mounted on the end of the drive shaft from above.

18 Claims, 1 Drawing Sheet

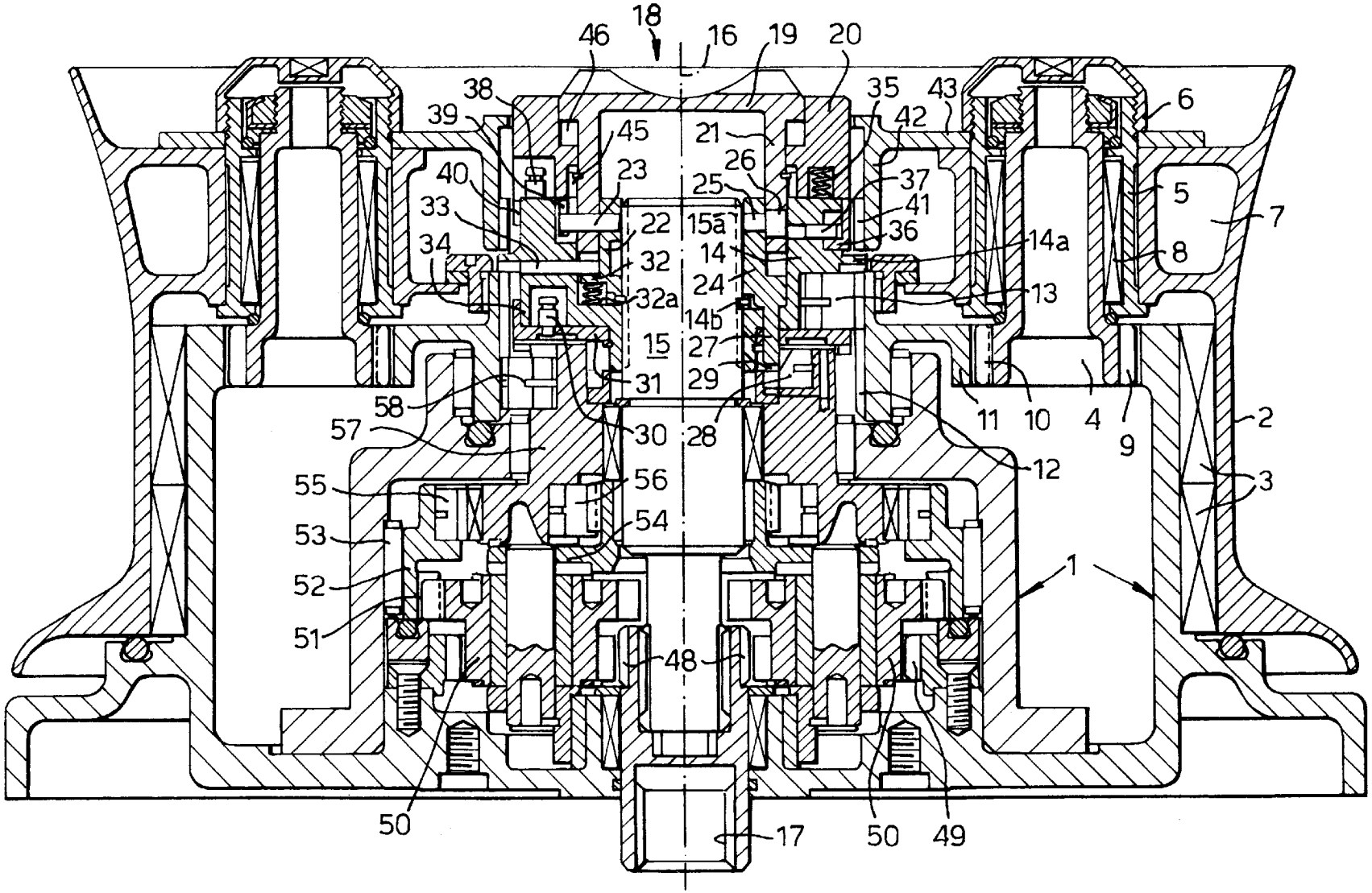
1
2
3
4
5
6
7
8
9
10
11
12
13
14a
14
14b
15
15a
16
17
18
19
20
21
22
23
24
25
26
27
28
29
30
31
32
32a
33
34
35
36
37
38
39
40
41
42
43
45
46
48
49
50
51
52
53
54
55
56
57
58

MULTI-SPEED WINCH HAVING SPEED SELECTION MECHANISM

FIELD OF THE INVENTION

This invention relates to a selection mechanism for use in a multi-speed winch, to select which of two alternative drive ratios shall be selected as the first to be communicated from a drive shaft to the drum of the winch, upon initial rotation of the drive shaft in a given direction, which conventionally is a clockwise direction. It is intended for winches where successive reversals of direction of drive of the main shaft automatically cause engagement of drive trains of successively different mechanical advantage.

BACKGROUND OF THE INVENTION

A mechanism of this general type is shown in our specification U.S. Pat. No. 3,973,755 (GB-A-148677) but that allows only a single alternative. By depression of a button or ring at the head of the winch the user will cause a first speed to be engaged upon clockwise rotation. If the button is not depressed the user will engage a third speed (the second is engaged upon anti-clockwise rotation).

GB-A-1524880 shows a mechanism having the same effect, i.e. the selector mechanism determines whether a first or a third ratio is engaged upon initial rotation.

EP-A-0211556 offers a choice of first or second ratios on initial rotation, but achieves this by two separate mechanisms, at the top and the middle of the drive shaft. The mechanism at the top offers, as in the prior art, only a choice of first and third ratios.

SUMMARY OF THE INVENTION

According to the present invention a single selection mechanism is provided which allows for alternative drive ratios to be engaged upon initial rotation of a drive shaft, both being of a drive ratio higher (i.e. of lower mechanical advantage) than a separate drive train to the winch which is engageable upon first reverse rotation of the drive shaft. The selection mechanism may further allow neither of those alternatives to be engaged. Preferably the winch will have further such drive trains of progressively lower ratio (higher mechanical advantage) and the selection mechanism may be provided with an automatic reset provision so that when one of the two alternative first drive ratios is selected, either or both as necessary will be disconnected upon first reversal of direction of the drive shaft, so that upon second reversal the second of the other drive trains is engaged. However, there may be a manually operated override of that reset, such that upon successive reversals the selected one of the two first drives and the first further drive ratio are alternately engaged.

In a particular embodiment, one of the two selectable alternative first drive ratios is a 1:1 direct drive, with the other being through a reduction train to the drum. Suitably this reduction train may be orbital gearing carried by the drum.

THE DRAWING

A particular embodiment of the invention is described in the accompanying drawing which is a section on two radii.

DESCRIPTION OF A PREFERRED EMBODIMENT

The drawing shows a winch at the base of which are provided at least one and preferably, as shown, two different trains to drive from a main shaft to the drum. These may be conventional or, as shown here, be an epicyclic arrangement in accordance with the invention in our copending U.S. application Ser. No. 08/934,997 filed Sep. 22, 1997 corresponding to UK Patent Application No. 9620313.8 filed Sep. 30, 1996.

In the present embodiment, the winch has a stationary frame 1 upon which a drum 2 is mounted for rotation on bearings 3. The drum is driven by the orbital rotation of planetary gears 4 which are journalled in bushings 5 in a housing 6 in a double web 7 at the head of the drum. The gears 4 are borne for rotation about their own axis by bearings 8 within the bushings 5.

Orbital motion is caused by the gear 4 being engaged between a stationary gear ring 9 at the head of the frame and a gear ring 10 on a drive member 11 which is rotated by one of the two selected drives, and is furthermore in this embodiment rotated by the other, epicyclic, drives from the base of the drum, but of higher mechanical advantage.

For the purpose of transmission of one of the selected drives the drive member 11 has a ratchet track 12 engaged by pawls 13 on a selector body 14 which is splined onto the top of a main drive shaft 15, coaxial with the drum, by splinings 15*a*, in such a way that the body can be mounted onto the shaft from above. It is retained there by entrapment of a flange 14*a* by a top cap 43 of the drum, and by circlip 14*b*. As an alternative to the circlip, a known quick-release mechanism may be provided between the top of the shaft and the button 19, being accessible through an aperture (not shown) in that button.

Drive comes from the main drive shaft 15 the axis of rotation 16 of which defines the axis of rotation of the drum, the centre of the orbit of the axes of the planetary gears 4 and the centreline of the drawing.

In this embodiment, drive to that shaft comes from below the winch into a splined socket 17 at the bottom of the shaft 15 but with an obvious modification of the control buttons about to be described, could equally come from the head of the winch.

A double selector mechanism 18 is seen at the head of the winch. This will determine which of, or neither of, two drive ratios of comparatively low mechanical advantage will be engaged upon first (clockwise) rotation of the shaft 15 as well as which drive ratio will be engaged upon second reversal of drive direction. One of these may be a 1:1 direct drive to the drum. It has a first control button 19 surrounded by a second, annular, control button 20.

Button 19 has a sleeve 21 associated with a sleeve 22 by a pin 23 which projects radially outwardly beyond sleeve 21. The sleeve 22 can pivot about the shaft 15. It has a narrow axial gap into which fits a tongue 24 capable of movement in the axial direction. Tongue 24 is linked by a pin 25 to the sleeve 21 via an inclined slot 26 in the latter, so that if the button 19 is turned relative to the shaft 15 there is a relative axial motion between the sleeve 21 and the tongue 24.

Button 19 with its sleeve 21 is shown in a depressed condition. It is rotated with the shaft 15 but is capable of a limited angular displacement relative to that shaft. In the depressed position a pin 27 on the tongue 24 has a locus in rotation which interferes with a spring-loaded face cam 28 pivoted on drive member 57, to be described, for pivotal movement about an axis parallel to axis 16. During a first rotation (here, as is normal, clockwise) the pin 27 in its depressed condition sweeps aside the spring-loaded face cam. But upon a reverse (anti-clockwise) rotation it meets an inclined face 29 of the cam 28 and is pushed upwardly and (relatively) rearwardly. During that movement a spring (not shown) extending between the selector body 14 and a post 30 on a flanged disc 31 accumulates potential energy which will be released when the button 19 is again depressed. The disc 31 is penetrated by the pin 27 so that it can turn about the shaft 15 only together with the sleeve 22. During the movement of the disc 31 a flange 34 on the disc interferes with pawls 13 and holds them out of engagement with the ratchet track 12. Then, upon reversal of direction of input drive one of the other trains, of higher mechanical advantage, will be engaged.

Release of the potential energy in this spring and the movement of the disc 31 is prevented by interaction between a ledge 32 on the sleeve 22 and an inwardly projecting pin 33 on the body 14, under the influence of a spring 32*a* urging the sleeve 22 (and button 19) upwardly. However, depression of the button 19 releases that interaction so that the sleeve 22 and hence the disc 31 is free to rotate relative to the body 14, when the flange 34 of the disc moves around and permits pawls 13 to be released into engagement with the track 12.

If however the button 19 is depressed and twisted pin 25 rides in the inclined slot 26 to cause an upward motion of the pin 27 relative to the cam 28 so that the pin 27 is in a locus in which it does not interfere with the cam 28. Then on reversal of the drive the pin 27 is not driven relatively rearwardly; a lower speed ratio can only be selected manually by reversal of the twist of the button 19.

The second control button 20 is also shown in a depressed condition in which it has against the urging of a spring 35 been pushed downwardly relative to selector body 14 so that a gapped ledge 36 of the button 20 is by virtue of a relative rotation of that button retained under a pin 37 projecting from the body 14. The relative rotation is due to the influence of a tension spring (not shown) anchored on post 38. The button 20 also has an axially directed pin 39 which can be engaged by the projecting part of pin 23 on the sleeve 21.

The button 20 has a projecting lug part 40 which upon relative rotation of that button engages the face of pawls (not shown) born on the body 14 to maintain them out of engagement with a ratchet track 41 on a flange 42 of the top cap 43 of the drum which is fast with the web 7 of the drum.

If these pawls drive on ratchet track 41 they give a direct one-to-one drive from the shaft 15 to the drum. An alternative first drive ratio is afforded via body 14, pawls 13, and ratchet track 12 on the intermediate ring 11, through the planetary gears 4 to the drum. A normal reduction given by such a gear is of the order of 2:1 to 3:1.

To set the winch so that upon first clockwise rotation the first ratio (direct drive) is engaged, button 20 is depressed. If button 19 was not already depressed it will be upon depression of button 20, by virtue of engagement of the latter with a circlip 45 on the sleeve 21. Depression of button 20 allows the ledge 36 to clear the pin 37 and rotate under the urging of the tension spring on post 38. Thus lug part 40 goes clear of the pawls on the body 14 so that the latter engage track 41. Likewise pin 33 coming clear of ledge 32 allows rotation to cause flanges 34 to come clear of pawls 13 so they can engage track 12. Although both drives are engaged, it is only the 1:1 drive via track 41 that is effective since the alternative first gear, having a higher mechanical advantage, is over-ridden by the faster gear causing pawls 13 to click. Upon reversal of rotation of the shaft 15 the face cam 29 is engaged by the pin 27 which pushes the sleeve tongue 27 upwards and rearwardly relative to the continued rotation of the main shaft. Sleeve 22 rotates so that ledge 32 is disengaged from pin 33 and button 19 is free to rise under the influence of spring 32*a*. Concurrently, pin 23 strikes lug part 40 and drives that relatively rearwardly so that the ledge 36 is disengaged from pin 37 and button 20 is free to rise under influence of spring 35.

Alternatively, to get one of the drive trains with the higher mechanical advantage (between 2 and 3:1) upon initial clockwise rotation, i.e. via member 11 and orbital gears 4, only button 19 is depressed which, because of the gap 46 between buttons 19 and 20, does not carry button 20 with it and causes only the inner part of the mechanism to function thereby engaging the lower pawls 13 with track 12. Upon clockwise rotation of the shaft this is the drive which is engaged.

If the button 19 was not also twisted, upon a first reversal of drive the pin 27 will engage with the cam 28 as described, to wipe out pawls 13 so that upon a second reversal they will not reengage.

The anti-clockwise rotation of the shaft engages the other gear train at the base of the winch, or the first of the others provided there, and upon a further reversal of direction (to clockwise) neither of the ratchet tracks 41 or 12 will drive.

The epicyclic trains in the base of the winch drive from a common gear ring 48 on the shaft via idlers (not shown) against a fixed gear ring 49 on the frame. Orbital gears 50 drive in accordance with the direction of rotation of the shaft 15 either to a rotatable gear ring 51 on a sleeve 52 borne by bearings 53 on the frame, or at a lower mechanical advantage to a carrier flange 54 rotatably journalled on the shaft 15. Sleeve 52 or flange 54 are coupled through respective pawl and ratchet unidirectional drives 55,56 to a common drive member 57 at the head of which are pawls 58 in permanent engagement with track 12. Since either of the drives in the upper part of the winch will when engaged cause faster rotation of the drive part 11 than the lower drives would, that is permissible; pawls 58 drive track 12 only when one of the other drive trains, due to epicyclics 50, is effective.

The cam 28 is mounted on the part 57; but will achieve the required rotation of the upper part or parts by virtue of the rotation of the part 57 being slower than that of sleeve 22 when either of the upper drives is engaged.

To summarize the possibilities offered by the control mechanism and designating the respective ratios 1–4 in descending order i.e. of increasing mechanical advantage:

A. If neither 19 nor 20 is depressed, first clockwise rotation will engage the second of the epicyclic trains in the base of the winch, and anticlockwise rotation the first of them i.e. 4→3→4 . . .

B. If only 19 is depressed, pawls 13 are engaged and drive is obtained on clockwise rotation to member 11, to the first of the base epicyclics on first anticlockwise rotation and to the second of the base epicyclics on second clockwise rotation i.e. 2→3→4→3→4 . . .

C. If 19 is depressed and twisted, as in B above except that there will be a return to drive member 11 on second clockwise rotation i.e. 2→3→2→3 . . .

D. If 20 is depressed, button 19 is carried down with it, pawls are engaged on the track 41 and 1:1 drive is obtained on first clockwise rotation, with pawls 13 clicking. Upon a first reversal the first of the base epicyclic trains is engaged and upon second reversal (second clockwise rotation) the second of the base epicyclic trains i.e.1→3→4→3→4 . . .

E. If 20 is depressed and 19 (having been carried down with it) is twisted, as in D above except that there will be a return to 1:1 drive upon second reversal i.e. 1→3→1→3 . . . .

Furthermore, the operator can engage 1st or 2nd speed by appropriate operation of the controls, at any time that the shaft is being stated clockwise.

We claim:

1. A winch comprising:

a drum;

a drive shaft coaxial with said drum, said drive shaft having an axial length from its bottom to its top and being rotatable in a forward direction and a reverse direction;

two alternative drive trains having different drive ratios;

a first supplemental drive train to which said drum is engageable upon reverse rotation of said drive shaft; and, a selection mechanism, mounted at the top of said drive shaft, for selecting which of said two alternative drive trains shall be the first to be communicated from said drive shaft upon rotation of said drive shaft in the forward direction, both of said two alternative drive trains having a drive ratio higher (lower mechanical advantage) than that of said first supplemental drive train.

2. A winch according to claim 1 wherein said selection mechanism further allows neither of said two alternative drive trains to be engaged upon rotation of said drive shaft in the forward direction of rotation.

3. A winch according to claim 2 further comprising a second supplemental drive train having a different drive ratio from said first supplemental drive train, the drive ratios of both of said first and second supplemental drive trains being of lower ratio (higher mechanical advantage) than the drive ratios of said two alternative drive trains, and wherein said selection mechanism is provided with an automatic reset provision so that (a) when one of said two alternative drive trains is selected, either or both as necessary will be disconnected upon first reversal of direction of said drive shaft so that upon second reversal of direction said second reverse drive train is engaged, and (b) when neither of said first and second alternative drive trains is engaged, either said first or said second supplemental drive train is engaged upon initial rotation of the drive shaft in dependence upon the direction of that rotation.

4. A winch according to claim 1 further comprising a second supplemental drive train having a different drive ratio from said first supplemental drive train, the drive ratios of both of said first and second supplemental drive trains being of lower ratio (higher mechanical advantage) than the drive ratios of said two alternative drive trains, and wherein said selection mechanism is provided with an automatic reset provision so that when one of said two alternative drive trains is selected, either or both as necessary will be disconnected upon first reversal of direction of said drive shaft so that upon second reversal of direction said second supplemental drive train is engaged.

5. A winch according to claim 4 wherein said selection mechanism further comprises a manually operated override of the automatic reset provision, such that upon successive reversals of direction of said drive shaft the selected one of said two alternative drive trains and said first supplemental drive train are alternately engaged.

6. A winch according to claim 4 wherein said first supplemental drive train and said second supplemental drive train are epicyclic drive trains adjacent the bottom of said drive shaft.

7. A winch according to claim 1 wherein said selection mechanism is mounted coaxially with said drive shaft and further comprises two selector buttons coaxially arrayed one outside the other for selective operation for achieving at least the selection of the two alternative drive ratios.

8. A winch according to claim 7 wherein said selector buttons select by axial depression.

9. A winch according to claim 8 wherein the outer of said selector buttons selects by axial depression and the inner of said selector buttons additionally selects by rotation relative to the outer button.

10. A winch according to claim 7 wherein said selection mechanism is borne on said drive shaft by a body mountable onto said drive shaft from above its top and releaseably retained thereon.

11. A winch according to claim 1 wherein said selection mechanism is borne on said drive shaft by a body mountable onto said drive shaft from above its top and releaseably retained thereon.

12. A winch comprising a drum rotatable about an axis;

a drive shaft coaxial with said drum, said drive shaft having an axial length from its bottom to its top and being rotatable in a forward direction and a reverse direction;

two alternative drive trains between the shaft and the drum for driving the drum in rotation in one direction and having different drive ratios;

first and second supplemental drive trains for driving the drum in rotation in the one direction and having different drive ratios both of which are lower (have higher mechanical advantage) than the drive ratios of the alternative drive trains;

both of the alternative drive trains and one of the supplemental drive trains for effecting drive from the drive shaft to the drive upon rotation of the drive shaft in the forward direction and the other of the supplemental drive trains for effecting said drive upon rotation of the drive shaft in the reverse direction; and a selection mechanism mounted at the top of said drive shaft for selecting which one of or neither of the two alternative drive trains shall be engaged upon initial rotation of the drive shaft in the forward direction.

13. A winch according to claim 12 wherein the selection mechanism further comprises a manually operated override of the automatic reset provision, such that upon successive reversals of direction of said drive shaft the selected one of said two alternative drive trains and said first supplemental drive train are alternately engaged.

14. A winch according to claim 13 wherein the selection mechanism comprises two selector buttons coaxially arrayed one outside the other for selective operation for achieving at least said selection of the two alternative drive ratios and said override.

15. A winch according to claim 14 wherein the outer of said selector buttons selects by axial depression and the inner of said selector buttons additionally selects by rotation relative to the outer button.

16. A winch according to claim 15 wherein said selection mechanism is borne on said drive shaft by a body mountable onto said drive shaft from above its top and retained thereon.

17. A winch according to claim 12 wherein said selection mechanism comprises two selector buttons coaxially arrayed one outside the other for selective operation for achieving at least said selection of the two alternative drive ratios.

18. A winch according to claim 17 wherein said selector buttons select by axial depression.

* * * * *